US008286303B2

(12) United States Patent
Amoretti

(10) Patent No.: US 8,286,303 B2
(45) Date of Patent: Oct. 16, 2012

(54) VACUUM CLEANER WITH WET SCRUBBER

(75) Inventor: Luigi Amoretti, Romano d'Ezzelino (IT)

(73) Assignee: TPA Impex SpA, Romano d'Ezzelino (Vicenza) (IT)

( * ) Notice: Subject to any disclaimer, the term of this patent is extended or adjusted under 35 U.S.C. 154(b) by 672 days.

(21) Appl. No.: 12/488,860

(22) Filed: Jun. 22, 2009

(65) Prior Publication Data

US 2009/0320232 A1 Dec. 31, 2009

(30) Foreign Application Priority Data

Jun. 27, 2008 (IT) ..... MO08A000182

(51) Int. Cl.
*A47L 9/18* (2006.01)

(52) U.S. Cl. ..... 15/347; 15/353

(58) Field of Classification Search ..... 15/347, 15/352, 353; *A47L 9/18*
See application file for complete search history.

(56) References Cited

U.S. PATENT DOCUMENTS

| | | | | |
|---|---|---|---|---|
| 5,030,257 | A * | 7/1991 | Kasper et al. | 96/333 |
| 5,829,092 | A * | 11/1998 | Hobbs | 15/352 |
| 6,553,614 | B1 * | 4/2003 | Leon | 15/353 |
| 7,246,406 | B2 * | 7/2007 | Yarbrough et al. | 15/353 |
| 7,370,389 | B2 * | 5/2008 | Tsen | 15/353 |
| 2005/0108849 | A1 * | 5/2005 | Lam | 15/353 |
| 2006/0272120 | A1 * | 12/2006 | Barrick et al. | 15/321 |

FOREIGN PATENT DOCUMENTS

JP 404084919 A * 3/1992

* cited by examiner

*Primary Examiner* — David Redding
(74) *Attorney, Agent, or Firm* — Themis Law

(57) ABSTRACT

A vacuum cleaner with wet scrubber includes a housing containing a scrubbing liquid, which defines a level of liquid having a free surface; an inflow opening conveying the air streams to be scrubbed under the free surface of the liquid; an outflow opening of the scrubbed air streams; a dynamic separator disposed in the proximity of the outflow opening; and cleaning means disposed in the housing and acting on the dynamic separator.

14 Claims, 3 Drawing Sheets

VACUUM CLEANER WITH WET SCRUBBER

FIELD OF THE INVENTION

The invention relates to a vacuum cleaner with a wet scrubber, adapted to scrub sucked air streams and to collect dirt sucked in with the air streams.

BACKGROUND ART

Vacuum cleaners have been known for some time, both for domestic and industrial use, which include systems for scrubbing sucked air that cause the air to be purified from dirt particles to bubble into a liquid.

In order to improve scrubbing efficiency, it is also known to provide a dynamic separation system in the upper portion of the housing where the scrubbing liquid is collected, which consists of a rotating element having radial blades with passage spaces therebetween.

This type of separation system is actuated by a motor or by the sucking system itself, and rotates to smash dirt particles down that may be suspended in the air streams that have entered into the housing through an inflow opening.

The housing is also provided with an outflow opening for the scrubbed air, and the separation system is typically placed at the entry to such outflow opening, such that only air streams that have been completely purified can exit through the outflow opening and be later directed toward the motor system for cooling and be finally delivered into the surrounding environment again.

In other words, particulate matter that is still suspended within the housing is sucked toward the outflow opening, but collides against the radial blades of the moving rotor and falls into the pool of scrubbing liquid placed underneath.

The prior art has a number of drawbacks.

A first drawback is that the rotor blades are always substantially damp due to moisture in the housing where the rotor is turning and that the particles hitting the blades are prone to sticking to the surfaces of the blades, progressively forming a dirt layer, which may increase over time and plug passage spaces, blocking the operation of the vacuum cleaner.

Such plugging requires that the vacuum cleaner be stopped and disassembled, in order to clean the blades of the rotor and restore the passages among the blades, and later be re-assembled to continue use.

Another drawback is that the inflow opening for the air streams is provided on a side of the housing, that is, crosses through a lateral wall of the housing, and is coupled to a tube segment that extends inside the housing and ends under the free surface of the scrubbing liquid.

Therefore, the bubbling of the air streams to be scrubbed occurs mainly at the outlet of the tube that extends into the scrubbing liquid, while in other areas of the housing the bubbling and, accordingly, the efficiency of filtration is reduced because the liquid has a natural tendency to attenuate turbulent flow.

Still another drawback is that typically the housing that contains the scrubbing liquid (normally water) is constructed with transparent walls, which enable a continuous view from the outside into the housing and a continuous view of the volume of dirt gathered in the liquid.

When the liquid becomes very dirty, it may assume a dark and opaque appearance that causes a feeling of repulsion and an impression of low hygiene in the users.

SUMMARY OF THE INVENTION

It is an object of the invention is to improve on the state of the prior art.

It is another object of the invention is to provide a vacuum cleaner with wet scrubber, which maintains a constantly clean rotor in the dynamic separation system, eliminating the need for a periodic cleaning to preserve the efficiency of the vacuum cleaner.

It is a further object of the invention to provide a vacuum cleaner with wet scrubber, which produces a homogeneous filtration in all areas of the housing containing the scrubbing liquid.

It is still another object of the invention to provide a vacuum cleaner with wet scrubber, which causes the appearance of the scrubbing liquid to be more visually pleasing even when it is substantially loaded with dirt particles collected from the scrubbed air streams.

According to an aspect of the invention, a vacuum cleaner with wet scrubber constructed according to the principles of the invention includes a containment housing for a volume of scrubbing liquid, which defines a level of liquid defined as free surface; an inflow opening for an air stream to be scrubbed, which ejects the air stream under the free surface; an outflow opening for the scrubbed air stream; means disposed at the outflow opening for dynamically separating impurities, wherein cleaning means are provided in the housing and act on the dynamically separating means.

A vacuum cleaner with wet scrubber according to the invention provides the following advantages:

the rotor of the dynamic separation system is mounted within the containment housing of the scrubbing liquid and remains in continuously efficient and clean condition;

a turbulent motion is created in all areas of the containment housing for the scrubbing liquid, causing filtration efficiency to be substantially homogeneous within the entire housing; and the scrubbing liquid retains an aesthetically pleasing look, even when the scrubbing liquid is loaded with dirt particles collected during the scrubbing of the sucked the air streams.

BRIEF DESCRIPTION OF THE DRAWINGS

Additional features and advantages of the invention will be more evident from a detailed description of a vacuum cleaner with wet scrubber according to the invention, illustrated in a non-limiting embodiment in the enclosed drawings, in which.

DETAILED DESCRIPTION OF EMBODIMENTS OF THE INVENTION

Detailed descriptions of embodiments of the invention are provided herein. It is to be understood, however, that the present invention may be embodied in various forms. Therefore, the specific details disclosed herein are not to be interpreted as limiting, but rather as a representative basis for teaching one skilled in the art how to employ the present invention in virtually any detailed system, structure, or manner.

Figure 1:
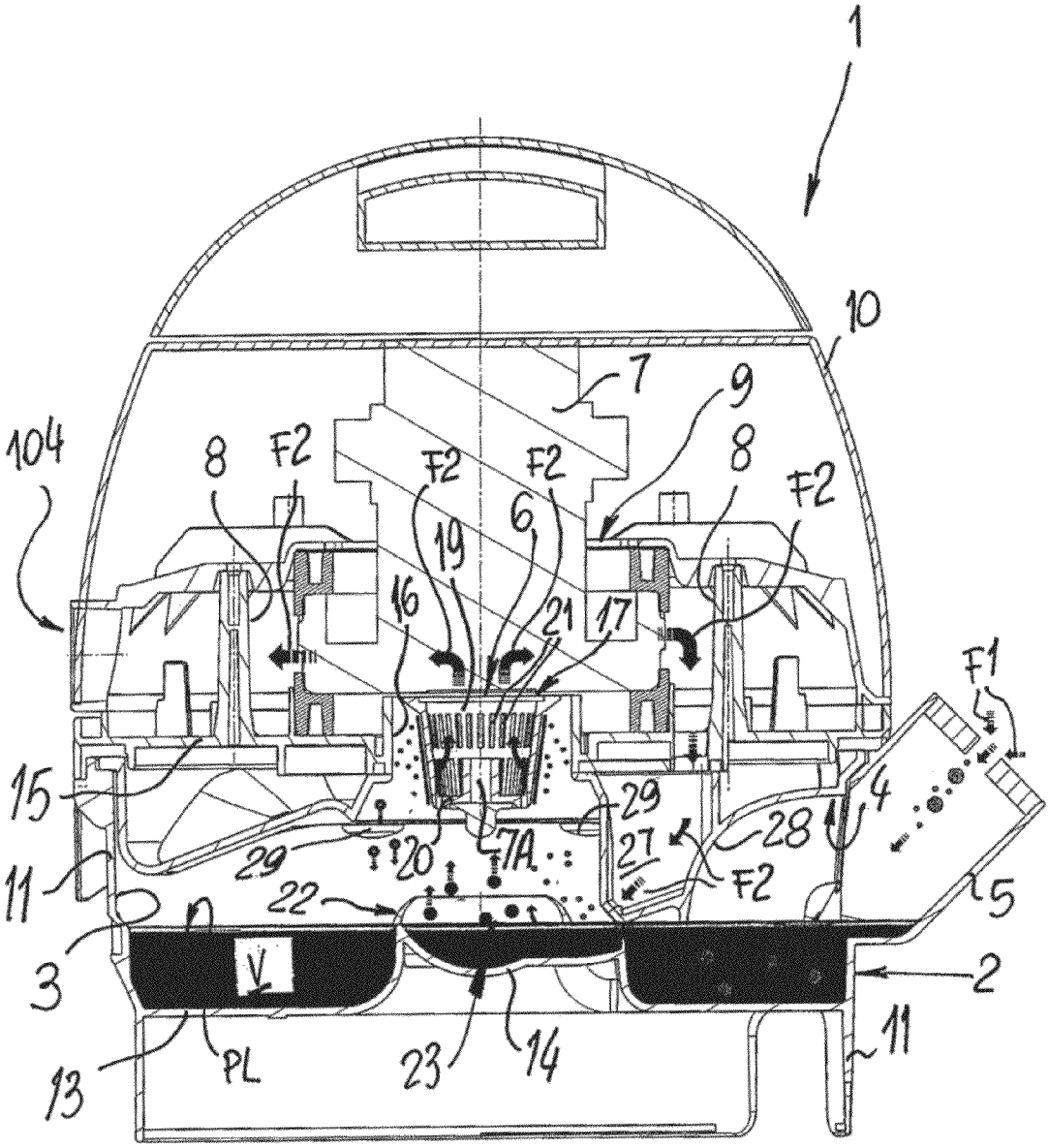
FIG. 1 is a vertical section view of a vacuum cleaner with wet scrubber according to the invention.
Figure 2:
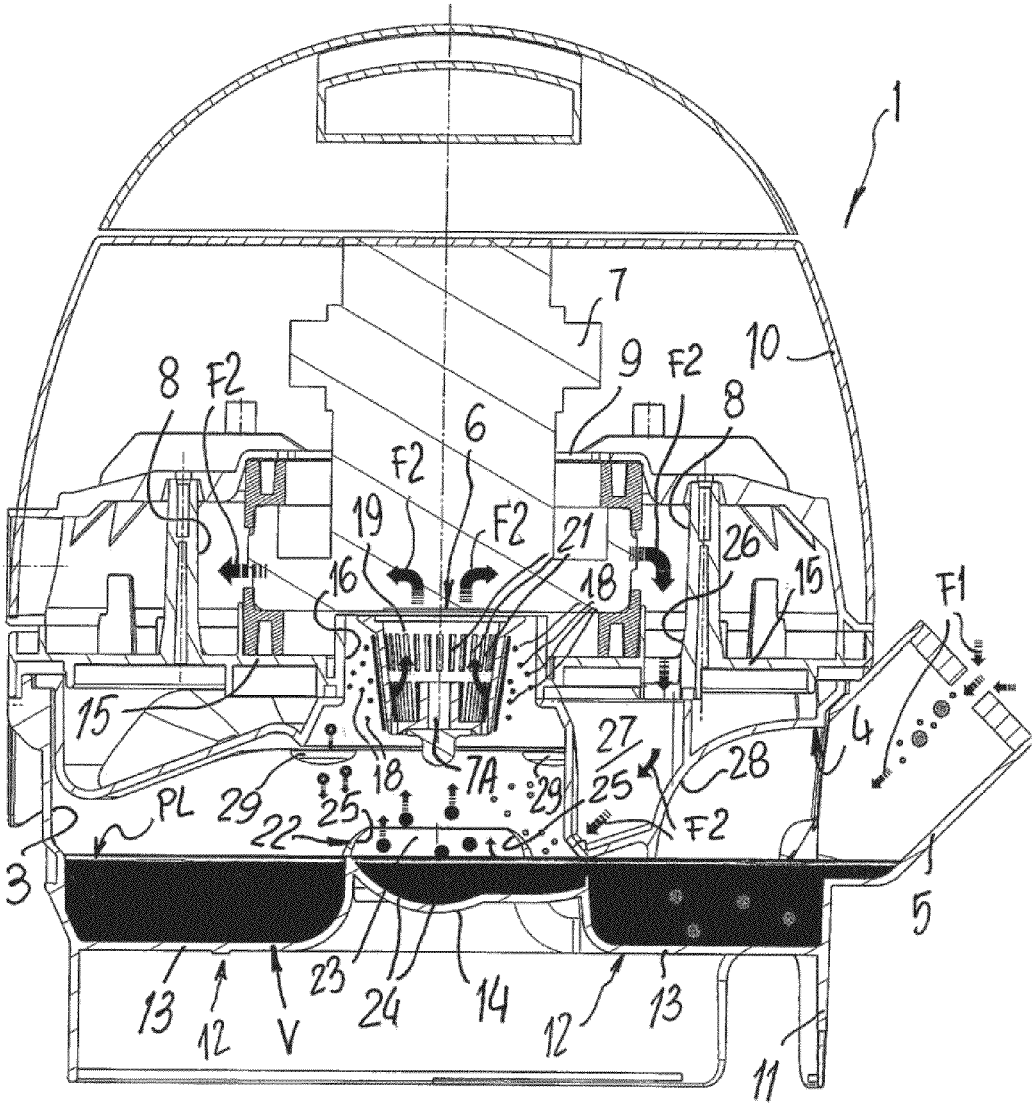
FIG. 2 is an enlarged view of a portion of the vacuum cleaner of FIG. 1.
Figure 3:
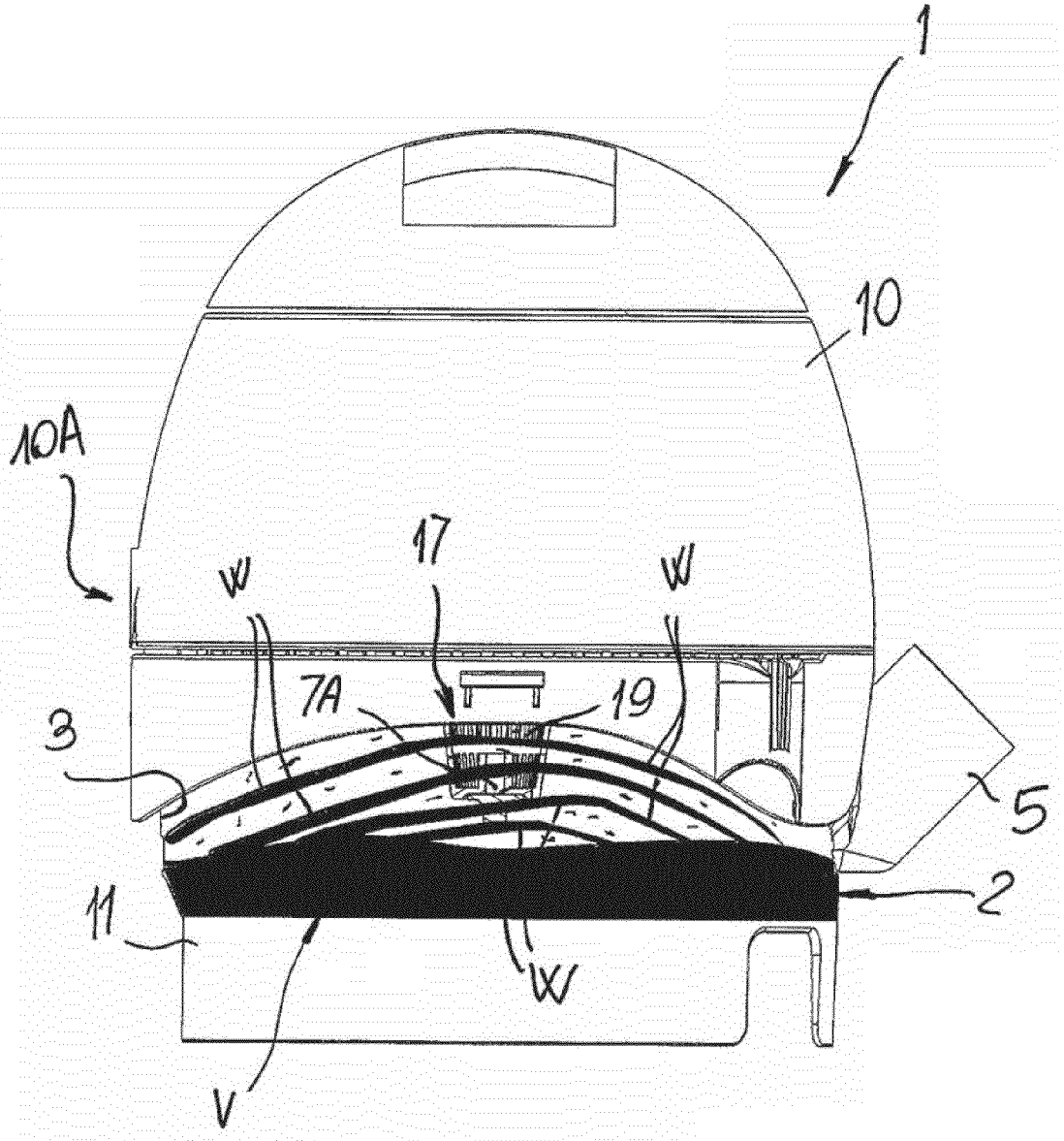
FIG. 3 is a view of the vacuum cleaner with wet scrubber in a schematic operational simulation.

Referring to the FIGS. 1-3, there is shown a vacuum cleaner 1 with wet scrubber 2 according to the invention, which is water-based in the present embodiment.

Vacuum cleaner 1 includes a housing 3 that contains a volume "V" of scrubbing liquid, which defines a level "PL," generally identified with the term "free surface."

Housing 3 is provided with an inflow opening 4. Air streams to be scrubbed, shown by arrows F1, enter housing 3 through inflow opening 4 and are ejected under free surface "PL."

As shown in the FIGS. 1-3, inflow opening 4 is provided with an inlet 5 configured to receive and engage a mating end of a sucking pipe, which is of a kind known to a person skilled in the art.

An outflow opening is also provided in housing 3. Scrubber air streams, shown by arrows F2, exit housing 3 through the outflow opening and are typically directed toward the outside environment through a related path, or toward a blow-through aperture 10A in vacuum cleaner 1 that is provided with coupling elements for a diffusion conduit.

Vacuum cleaner 1 includes a motor system 7 that housed within a chamber 8 defined within a support structure 9. Support structure 9 is manufactured with a molding process and is disposed within an upper half-shell 10, which is coupled to a corresponding lower half-shell 11 to form jointly the body of vacuum cleaner 1.

Housing 3 is disposed within lower half-shell 11 and includes a bottom wall 12, preferably shaped as an annular portion 13, and a central portion 14, slightly raised with respect to annular portion 13.

A transversal wall 15 is disposed between upper half shell 10 and lower shell 11 and is also shaped and manufactured with a molding process. Transversal wall 15 is substantially parallel to bottom wall 12 and closes the upper area of housing 3. Transversal wall 15 defines a concave seat 16, within which a dynamic separator 17 is housed to separate dirt particles 18 from air streams, which were previously scrubbed by volume "V" of the scrubbing liquid and within which these particles 18 may have remained suspended.

As it can be seen in the FIGS. 1-3, concave seat 16 is provided at outflow opening 6, which, for all practical purposes, is the bottom portion of outflow opening 6.

A rotor 19 is disposed within concave seat 16 and is rotatably supported by a support 20, which is engaged with a rotating motorized shaft 7A that extends from motor system 7 and that enables rotor 19 to rotate.

Rotor 19 includes a frusto-conical body having a minor base facing housing 3 and further having a plurality of radial windows defined therethrough. These through-windows are arranged to be traversed by air streams F2, scrubbed in volume "V" of the scrubbing liquid, to reach outflow opening 6 and move toward the outside of vacuum cleaner 1 or toward blow-through aperture 10A provided in vacuum cleaner 1.

Cleaning means 22, acting on the dynamic separator, are provided in housing 3 and are disposed vertically near rotor 19.

These cleaning means 22 include a nebulizer and spray element 23, which is configured to spray rotor 19 in substantially constant fashion during operation of rotor 19.

Nebulizer element 23 is configured to spray rotor 19 using the same scrubbing liquid forming volume "V", and for that reason is provided with a plurality of entry openings 24, defined in the lower portion of nebulizer element 23 and kept under free surface "PL", and with an upper spray opening 25, which is directed toward rotor 19 and is kept above free surface "PL".

Scrubbed air streams F2, from which dirt particles of larger dimensions have been removed and collected into chamber 8, are conveyed in the direction of spray element 23 through a channeling path, which includes a first stretch 26 provided in support structure 9 that is connected to a second stretch 27 defined within housing 3 and ending near one of entry openings 24 of nebulizer element 23. In all, the channeling path has an inflow end in the proximity of the outflow area of the air streams scrubbed by the dynamic separator and an opposite end in the proximity of the scrubbing liquid.

A diverter is provided inside housing 3 and includes a concave transversal barrier 28 having a concavity facing inflow opening 4 and disposed to be hit by un-scrubbed air streams F1. Concave transversal barrier 28 deviates such air streams into volume "V" of the scrubbing liquid, generating both a distribution of such streams that is substantially diffused along two opposite circular directions within the entire volume "V" to improve scrubbing action, and a turbulent motion, having a wavy motion that generates waves "W" and a bubbling motion, to favor the separation and deposit of the sucked dirt particles.

Concave transversal barrier 28 may be disposed such to be hit by the incoming air streams to be scrubbed substantially perpendicularly or transversally.

In a more complete embodiment of vacuum cleaner 1, lights 29 are mounted onto transversal wall 15. Lights 29 are directed toward housing 3 and are of such color to modify the appearance of scrubbing liquid "V", providing it with a more pleasing look. It has been observed through tests that were performed that shades of a pale and dark blue color provide the best results.

In another embodiment of vacuum cleaner 1, lights 29 are also be bactericidal or fungicidal, for example, may be ultraviolet lights.

The operation of vacuum cleaner 1 is as follows:

When vacuum cleaner 1 is started by a user, motor system 7 generates a sucking action through a suitable fan actuated by the motor, which causes a collection of the dirt particles from a surface to be cleaned.

Such sucking action occurs through a conventional sucking tube connected to inlet 5 of inflow opening 4 and generates an air stream F1 to be scrubbed that originates from the exterior environment and is directed toward housing 3.

The sucked and unscrubbed air stream F1 hits transversal barrier 28 in a direction substantially perpendicular to the surface of barrier 28 and is directed by barrier 28 in two opposite directions along the walls of housing 3, within volume "V" of the scrubbing liquid, that is typically water. Air stream F1 causes a turbulent motion of the scrubbing liquid that typically includes a wavy motion with waves "W", as schematically shown in FIG. 3, and a bubbling motion and causes a separation of the largest and heaviest dirt particles, collected and carried by sucked air stream F1, from sucked air stream F1, collecting these particles in volume "V" of the scrubbing liquid.

At the same time, scrubbed air stream F2 is sucked through radial windows 21 defined in rotor 19, which is rotatably actuated by motor system 7 by means of motorized shaft 7A, and through outflow opening 6, reaching chamber 8 and then continuing from chamber 8 in the direction of nebulizer element 23 through stretches 26 and 27 of the channeling path.

Scrubbed air streams F2, which may still carry microscopic and light impurities in suspension, are diverted in the direction of entry openings 24 of nebulizer element 23, which are disposed under free surface "PL" of the scrubbing liquid.

This way, scrubbed air streams F2 act as a propellant of the scrubbing liquid and forcefully push the scrubbing liquid in the direction of the upper spray opening 25, from which it is directed, typically in droplet form, toward rotor 19, spraying rotor 19 constantly while in rotation and maintaining rotor 19 free from possible material build-ups thereon.

The scrubbing liquid is pushed toward rotor 19 captures even very small dirt particles, which may still be suspended inside housing 3 because of bubbles formed in the scrubbing liquid.

When the sucking action in the direction of inflow opening 4 becomes temporarily ineffective, for example because of a temporary partial obstruction that may occur at the mouth of the sucking conduit, motor system 7 increases its speed of rotation accordingly, causing an increase in sucking action.

Scrubbed air streams F2, which are directed toward entry openings 24 after cooling, increase in speed, causing an increase in the propulsive force on the scrubbing liquid, which, consequently, sprays rotor 19 with greater power.

This condition ends as soon as the partial obstruction is removed and rotor 19 is sprayed with normal power.

Lights 29 illuminate housing 3 during operation of vacuum cleaner 1 and, in the event that lights 29 are have bactericidal and/or fungicidal properties, scrubbed air streams F2 become even more purified not only from dirt particles, but also from micro-organisms such as mites and the like, reducing the risk of allergies for the users.

Moreover, lights 29 are preferably of pale or dark blue shades, causing the scrubbing liquid to achieve a substantially pleasing appearance even when such liquid is nearly saturated with collected particulate matter.

Lights 29 may also be of other colors.

While the invention has been described in connection with the above described embodiments, it is not intended to limit the scope of the invention to the particular forms set forth, but on the contrary, it is intended to cover such alternatives, modifications, and equivalents as may be included within the scope of the invention.

What is claimed is:

1. A vacuum cleaner with wet scrubber comprising:

a housing configured to contain a volume of scrubbing liquid, the scrubbing liquid defining a level of the scrubbing liquid having a free surface;

an inflow opening for air streams to be scrubbed, the inflow opening directing the air streams under the free surface;

an outflow opening for scrubbed air streams;

a dynamic separator for impurities, the dynamic separator being disposed in a proximity of the outflow opening; and a cleaning apparatus disposed in the housing, the cleaning apparatus acting on the dynamic separator, wherein the cleaning apparatus comprises a spraying apparatus, the spraying apparatus spraying the dynamic separator with the scrubbing liquid.

2. The vacuum cleaner of claim 1, wherein the spraying apparatus comprises:

a nebulizer and spray element disposed at least partially under the free surface, the nebulizer and spray element having at least one spray opening directed toward the cleaning apparatus and at least one entry opening for the scrubbing liquid fluidly connected with the spray opening; and a channeling path for air streams propelling the scrubbing liquid, the channeling path being defined between a source of the propelling air streams and the at least one entry opening for the scrubbing liquid.

3. The vacuum cleaner of claim 2, wherein the at least one spray opening is disposed above the free surface, and wherein the at least one entry opening for the scrubbing liquid is disposed below the free surface.

4. The vacuum cleaner of claim 2, wherein the channeling path comprises an inflow end in a proximity of an outflow area of the air streams scrubbed by the dynamic separator and an opposite end in a proximity of the scrubbing liquid.

5. The vacuum cleaner of claim 1, wherein the dynamic separator comprises a rotor having a side surface, through which a plurality of radial through-windows are provided, the rotor being mounted in the proximity of the outflow opening, the through-windows being configured to enable a through passage of the scrubbed air flows toward the outflow opening.

6. The vacuum cleaner of claim 1, wherein the outflow opening includes a blow-through aperture directed toward an outside of the vacuum cleaner, the blow-through aperture having an attachment element for a diffusion conduit.

7. The vacuum cleaner of claim 1, wherein the scrubber air streams comprise air streams directed in a direction of a blow-through aperture toward an outside of the vacuum cleaner.

8. The vacuum cleaner of claim 1, wherein the dynamic separator and the cleaning apparatus are arranged collinearly, the cleaning apparatus being coupled to a bottom wall of the housing, the dynamic separator being coupled to a transversal wall covering the housing and substantially parallel to the bottom wall.

9. The vacuum cleaner of claim 1, wherein the housing comprises a diverter of the air streams to be scrubbed.

10. The vacuum cleaner of claim 9, wherein the diverter comprises a barrier disposed transversally in relation to the inflow opening, such to be hit by the air streams to be scrubbed in a substantially perpendicular direction.

11. The vacuum cleaner of claim 10, wherein the barrier comprises a concave profile having a concavity facing the inflow opening and configured to subdivide the air streams to be scrubbed in at least two opposite directions.

12. The vacuum cleaner of claim 8, further comprising lights mounted on the transversal wall, the lights illuminating the housing.

13. The vacuum cleaner of claim 12, wherein the lights comprise one or more of bactericidal or fungicidal lights.

14. The vacuum cleaner of claim 1, wherein the housing and the inflow opening are provided in a lower half-shell of the vacuum cleaner, further comprising an upper half-shell closing the lower half-shell, a motor system being disposed within the upper half-shell and actuating the dynamic separator.

* * * * *